US012571061B2

(12) United States Patent
Hu et al.

(10) Patent No.: US 12,571,061 B2
(45) Date of Patent: Mar. 10, 2026

(54) BLOWING CONTROL METHOD FOR MAINTAINING MUSHROOM HEAD OF BOTTOM-BLOWING NOZZLE CONVERTER

(71) Applicant: SOOCHOW UNIVERSITY, Suzhou (CN)

(72) Inventors: Shaoyan Hu, Suzhou (CN); Rong Zhu, Suzhou (CN); Deyong Wang, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 584 days.

(21) Appl. No.: 17/927,057

(22) PCT Filed: Jul. 22, 2021

(86) PCT No.: PCT/CN2021/108009
§ 371 (c)(1),
(2) Date: Nov. 22, 2022

(87) PCT Pub. No.: WO2021/239161
PCT Pub. Date: Dec. 2, 2021

(65) Prior Publication Data

US 2023/0287529 A1 Sep. 14, 2023

(30) Foreign Application Priority Data

May 23, 2020 (CN) ..... 202010444563.5

(51) Int. Cl.
*C21C 5/34* (2006.01)
*C21C 5/46* (2006.01)

(52) U.S. Cl.
CPC ..... *C21C 5/34* (2013.01); *C21C 5/4606* (2013.01); *C21C 2005/4626* (2013.01)

(58) Field of Classification Search
CPC . C21C 5/34; C21C 5/4606; C21C 2005/4626; C21C 2250/08; C21C 5/48; C21C 5/35; C21C 7/0037
USPC ..... 266/47, 80, 82, 78, 224, 225; 75/530
See application file for complete search history.

(56) References Cited

U.S. PATENT DOCUMENTS 4,388,113 A * 6/1983 Takemura ..... C21C 5/34 266/46
4,422,873 A * 12/1983 Yamada ..... C21C 5/35 75/539
5,584,909 A 12/1996 Kim

FOREIGN PATENT DOCUMENTS

CN 101492755 A 7/2009
CN 102226226 * 10/2011 ..... C21C 5/34
CN 105907914 A 8/2016
CN 106086289 A 11/2016
CN 111455127 A 7/2020
EP 3514248 A1 7/2019

OTHER PUBLICATIONS

CN102226226, Minggang et al., Method For Preventing Mushroom Head From Being Blocked In Converter Steelmaking, Oct. 26, 2011 (Year: 2011).*
CN105907914, A Steel-making Method Of Bottom Blowing Oxygen Using CO2 Prolong The Life Of Converter, Rong et al. Aug. 31, 2016 (Year: 2016).*
Tang, Chongqing University Master's Thesis, Jan. 15, 2007.

* cited by examiner

*Primary Examiner* — Jessee R Roe
*Assistant Examiner* — Michael Aboagye
(74) *Attorney, Agent, or Firm* — SZDC Law PC

(57) ABSTRACT

A blowing control method for maintaining a mushroom head of a bottom-blowing nozzle converter is disclosed. Considering the actual state of the mushroom head at the end of the bottom-blowing nozzle tip, the real-time molten steel overheating change during the blowing process, the process requirements of different stages of blowing conversion, and the macroscopic heat balance of the converter, the oxygen-carbon dioxide-lime powder blowing parameters of the inner tube of the bottom-blowing nozzle are dynamically adjusted during the converter smelting process of the bottom-blowing nozzle converter so as to control the cooling intensity, thus achieving precise control of the size of the mushroom head. The present invention maintains the basic stability of the size of the mushroom head at the end of the bottom-blowing nozzle tip, avoiding nozzle blockage caused by an oversized mushroom head and rapid erosion of the nozzle caused by an undersized mushroom head.

4 Claims, No Drawings

BLOWING CONTROL METHOD FOR MAINTAINING MUSHROOM HEAD OF BOTTOM-BLOWING NOZZLE CONVERTER

This application is the National Stage Application of PCT/CN2021/108009, filed on Jul. 22, 2021, which claims priority to Chinese Patent Application No. 202010444563.5, filed on May 23, 2020, which is incorporated by reference for all purposes as if fully set forth herein.

TECHNICAL FIELD

The invention belongs to the technical field of bottom-blowing nozzle converter steelmaking, and in particular relates to a blowing control method for maintaining mushroom head of bottom-blowing nozzle converter.

BACKGROUND TECHNIQUE

Bottom-blowing nozzle converter is an advanced steelmaking method that lime required for steelmaking is sprayed into the metal molten pool from the bottom in the form of powder, which can significantly improve the metallurgical reaction efficiency and has significant advantages in reducing the consumption of raw and auxiliary materials for steelmaking, improving the purity of steel and reducing the amount of solid waste generated in the steelmaking process.

Although the bottom spray powder converter has excellent metallurgical effect, but the bottom blowing nozzle erosion fast, the bottom of the short life of the problem fundamentally hindered its engineering applications. A large number of experimental studies and engineering practice shows that the mushroom head covering the end of the bottom blowing nozzle is the key barrier to protect the bottom blowing nozzle against high temperature steel erosion, the size and shape of the mushroom head directly determines the erosion rate of the bottom blowing nozzle and working condition, the mushroom head is too small will accelerate the erosion of the bottom blowing nozzle, the mushroom head is too large and easy to cause nozzle blockage, the mushroom head size control within a reasonable range is particularly important. In the bottom spray powder converter steelmaking process, the composition and temperature of the steel, the reaction state in the furnace are changing over time, the state of the mushroom head will also change, so it is necessary to develop a dynamic blowing process system to control the growth rate of the mushroom head fall.

Technical Problem

This invention provides a method for control the growth rate of the mushroom head in the bottom-blowing nozzle. On the actual state, variations the molten steel overheating degree of the mushroom head during blowing process, the needs of the different blowing stages and the macro heat balance of the converter. Dynamically adjust the oxygen, carbon dioxide and lime powder blowing parameters of the inner tube of the bottom blowing nozzle in stages during the blowing process to maintain the basic stability of the mushroom head size and achieve effective protection of the mushroom head on the bottom blowing nozzle.

The mushroom head at the end of the bottom blowing nozzle is formed by condensation of molten steel, and both lime powder and carbon dioxide have the effect of cooling the bottom-blowing nozzle, but the amount of lime powder and carbon dioxide have significant impact on the metallurgical effect of the converter, and the total amount of lime powder blown and the timing of the blown need to be combined with the demand of the steel-making process, while the carbon dioxide blown will increase the heat loss of the converter; the present invention uses an equal amount of carbon dioxide instead of oxygen after lime powder blowing, and creatively limits the intensity of carbon dioxide blowing by correlating the overheating of steel with the cooling intensity required for steel condensation, the disclosed method has a very good maintenance effect on the growth of mushroom head in the bottom-blowing nozzle converter, especially on the premise of less carbon dioxide consumption while meeting the maintenance demand of mushroom head.

Technical Solutions

As the mushroom head covers the end of the bottom blowing nozzle, the invention uses the ratio of gas flow rate and pressure in the narrow annuli channel of the bottom-blowing nozzle to characterize the actual size of the mushroom head; lime is a necessary auxiliary material for slagging in the converter, the main purpose of the converter blowing lime powder is to remove impurity elements such as silicon, manganese, phosphorus and sulfur from the iron water, the invention is limited to spray blowing lime powder in the pre-blowing period.

Technical Solutions

The technical solutions of the present invention are,

A blowing control method for maintaining the mushroom head of a bottom-blowing nozzle converter is in characterized that, it comprises the following steps:

(1) Before smelting of the bottom-blowing nozzle converter, measuring the gas flow rate and gas pressure of the narrow annuli channel blowing by the nozzle, and calculating state coefficient of the mushroom head;

(2) After smelting of the bottom-blowing nozzle converter, oxygen is the carrier gas when spray blowing lime powder. After spray blowing lime powder, replace the oxygen with the same amount of carbon dioxide to form a carbon dioxide-oxygen mixed gas and continue blowing until the end of the smelting process to serving the mushroom head of a bottom-blowing nozzle converter; according to state coefficient of mushroom head and the blowing strength during adjust the carbon dioxide in the smelting process; the molten steel overheating degree ΔT is calculated according to Formula 1:

$$\Delta T = T - Tu \quad \text{(Formula 1)}$$

Wherein, T is the temperature of molten steel during the smelting process; Tu is calculated according to formula 2:

$$Tu = 1536.6 - 88\times\omega[C] - 8\times\omega[Si] - 5\times\omega[Mn] - 30\times\omega[P] \quad \text{(Formula 2)}$$

Wherein, ω[C] is the mass fraction of carbon in molten steel, ω[Si] is the mass fraction of silicon in molten steel, ω[Mn] is the mass fraction of manganese in molten steel, and ω[P] is the mass fraction of phosphorus in molten steel.

As the converter steelmaking control model is becoming more and more perfect and has been widely used, the steelmaking control system can accurately obtain the real-time temperature and composition of molten steel during the blowing process, thereby calculating the real-time molten steel overheating degree.

Before smelting of the bottom-blowing nozzle converter, the ratio of the gas flow rate and the gas pressure in the narrow annuli channel of the bottom-blowing nozzle is used to characterize the size of the mushroom head at the end of the nozzle, and the mushroom head state coefficient is obtained;

During smelting of the bottom-blowing nozzle converter, the steel control system obtains real-time composition and temperature of molten steel, and the bottom-blowing control system calculates the solidification temperature of molten steel in real time, which according to the molten steel composition, and calculates the molten steel overheating degree in real time according to the temperature of molten steel;

After smelting of the bottom-blowing nozzle converter, firstly oxygen is the carrier gas when spray blowing lime powder. The total amount of lime powder is calculated by the steelmaking control system. Then after blowing lime powder completely, carbon dioxide is used to replace oxygen. The blowing intensity of carbon dioxide is based on the state of the mushroom head before the start of smelting. Coefficient and the real-time molten steel overheating degree during the smelting process;

The invention dynamically adjusts blowing parameters of the oxygen, carbon dioxide and lime powder in the inner pipe channel of the bottom-blowing nozzle during the bottom spray blowing process, which enables stable control of mushroom head size while efficiently accomplishing smelting goals.

The present invention specifically includes the following steps, (1) Before smelting of the bottom-blowing nozzle converter, reading the gas flow rate Q and gas pressure P of the narrow annuli channel blowing by the nozzle in step (1) and the ratio of Q and P is defined as actual flow pressure ratio $\varepsilon_A$, and the ratio of actual flow pressure ratio $\varepsilon_A$ to reference flow pressure ratio ER is defined as mushroom head state coefficient $\eta$.

(2) Before smelting of the bottom-blowing nozzle converter, the steelmaking control system calculates the total amount of lime powder this time according to structure and composition of the furnace charge $M_{CaO}$.

(3) In the smelting of the bottom-blowing nozzle converter, using the steelmaking control system to obtain real-time composition and temperature T of molten steel; the mass fraction of carbon in molten steel $\omega[C]$, the mass fraction of silicon $\omega[Si]$, the mass fraction of manganese $\omega[Mn]$, and the mass fraction of phosphorus $\omega[13]$.

The steelmaking control system calculates the solidification temperature Tu (Formula 2) of molten steel according to the composition of the molten steel, and according to the temperature T of molten steel, calculates the real-time molten steel overheating degree $\Delta T$ (Formula 1).

$$\Delta T = T - Tu \quad \text{(Formula 1)}$$

$$Tu = 1536.6 - 88\times\omega[C] - 8\times\omega[Si] - 5\times\omega[Mn] - 30\times\omega[P] \quad \text{(Formula 2)}$$

(4) After smelting of the bottom-blowing nozzle converter, oxygen is the carrier gas when spray blowing lime powder, the blowing intensity of oxygen ranges from 0.8 to 1.2 ($Nm^3$/t/min), the blowing intensity of lime powder ranges from 4 to 6 (kg/t/min), when the spray blowing amount of lime powder reaches the steelmaking control system calculates the total amount of lime powder $M_{CaO}$, to stop the spray blowing.

(5) After spray blowing lime powder, at the same time, to spray blowing carbon dioxide. The oxygen is replaced by the same amount of carbon dioxide. According to the mushroom head state coefficient $\eta$ and the real-time molten steel overheating degree $\Delta T$ to adjust the blowing intensity of carbon dioxide, as follows: If $\Delta T \leq 100°$ C., the blowing intensity of carbon dioxide $I = \eta \times I_R$;

If 100° C.$<\Delta T \leq 150°$ C., the blowing intensity of carbon dioxide $I = 1.5\times\eta I_R$;

If the molten steel overheating $\Delta T$ 150° C., the blowing intensity of carbon dioxide $I = 2\times\eta\times I_R$; $I_R$ is the reference blowing intensity of carbon dioxide.

Further, the reference flow pressure ratio $\varepsilon_R = \alpha\times\varepsilon_u$;

$\varepsilon_u$ is the flow pressure ratio of the end of the narrow annuli channel blowing by the nozzle freely, which is measured before the bottom blowing nozzle is installed in the bottom-blowing nozzle converter. That a is the conversion factor, that ranges (0.6, 0.7).

Further, the reference blowing intensity of carbon dioxide ranges from 0.2 to 0.3 ($Nm^3$/t/min).

Beneficial Effect

The beneficial effects of the present invention are:

(1) The present invention uses the mushroom head state coefficient to adjust the blowing intensity of the cooling medium in the blowing process, which can effectively maintain the stable size of the mushroom head and avoid the mushroom head from being too large or too small;

(2) During the blowing process, the blowing intensity of the cooling medium is dynamically adjusted according to the degree of molten steel superheat, which can obtain an excellent cooling effect while reducing the amount of cooling medium;

(3) The present invention is based on the mushroom head state coefficient and the molten steel flow during the smelting process. The heat adjusts the carbon dioxide blowing intensity, which is beneficial to enhance the nozzle cooling in the later stage of smelting, forming a metal mushroom head with low carbon content and high melting point, and enhancing the corrosion resistance of the mushroom head.

EXAMPLES OF THE INVENTION

Detailed Description of the Examples

The invention is based on the actual state, variations of the molten steel overheating degree of the mushroom head during blowing process, the needs of the different blowing stages and the macro heat balance of the converter. The cooling intensity of the end of the bottom-blowing nozzle in stages is dynamically adjusted based on the actual state of the mushroom head, the change of molten steel superheat in the blowing process and the steelmaking process requirements, thereby controlling the growth rate of the mushroom head. The invention dynamically adjusts the cooling intensity of the bottom blowing nozzle according to the change in the degree of molten steel superheat, which can effectively stabilize the size of the mushroom head and reduce the amount of carbon dioxide used.

The bottom blowing of the bottom-blowing nozzle converter is a double-layer casing structure, in which the inner tube is used to blowing carbon dioxide, oxygen and lime powder, and the annular seam between the inner tube and the outer tube is used to blowing cooling media such as natural gas and nitrogen. The oxygen sprayed by the inner tube is the main source of heat release. The carbon dioxide and lime powder sprayed by the inner tube have different degrees of cooling effect. The present invention adjusts the bottom blowing nozzle by adjusting the mixed blowing parameters of oxygen, carbon dioxide and lime powder in the inner tube. The cooling strength of the end; but the mixing ratio and mixing timing of carbon dioxide and lime powder are very important, otherwise it will destroy the heat balance of the converter steelmaking and increase the consumption of raw and auxiliary materials for the converter steelmaking.

Example 1

The present invention was applied to a 120-ton bottom-spraying converter. The bottom-blowing nozzle was a double-layer casing structure. The inner pipe channel of the bottom-blowing nozzle was used to blowing oxygen, carbon dioxide and lime powder. The total blowing intensity of oxygen and carbon dioxide designed to be 1.0 $Nm^3/t/min$, and the blowing intensity of lime powder was designed to be 6 kg/t/min; nitrogen as a cooling protection gas blowing by the narrow annuli channel, the blowing intensity of nitrogen was 0.2 $Nm^3/t/min$. In addition, in order to increase the oxygen intensity and speed up the smelting rhythm, the converter uses a four-hole supersonic oxygen lance for top-blowing oxygen, and the top-blowing intensity of oxygen was 2.5 $Nm^3/t/min$.

Testing the flow rate of narrow annuli channel was 24 $Nm^3/t/min$ before installing the bottom-blowing nozzle, the pressure was 0.8 MPa, the flow-pressure ratio ($\varepsilon_u$) in the unobstructed state was 30, nitrogen as a cooling protection gas, the conversion factor $\alpha$ was 0.6, the reference flow pressure ratio $\varepsilon_R$ was 18, the reference blowing intensity of carbon dioxide $I_R$ was 0.3 $Nm^3/t/min$. The smelting step of any of the furnaces of the converter was taken as an example. The specific steps were as follows:

(1) Before smelting of the bottom-blowing nozzle converter, reading the gas flow rate was 24 $Nm^3/t/min$, and gas pressure was 1.0 MPa, the actual flow pressure ratio $\varepsilon_A$ was 24, the mushroom head state coefficient $\eta=\varepsilon_A/\varepsilon_R=24/18=4/3$, indicates that the size of the mushroom head was smaller.

(2) Before smelting of the bottom-blowing nozzle converter, the steelmaking control system calculates the total amount of lime powder this time according to structure and composition of the furnace charge $M_{CaO}$ was 30 kg/t steel.

After smelting of the bottom-blowing nozzle converter, oxygen was the carrier gas when spray blowing lime powder, the blowing intensity of oxygen was 1.0 $Nm^3/t/min$, the blowing intensity of lime powder was 6 kg/t/min, cooling the bottom blowing nozzle uses the physical endothermic effect of the temperature rise of the lime powder. After 5 minutes of continuous powder spraying, the amount of lime powder blowing reaches the total amount of lime powder calculated by the steelmaking control system, and the lime powder spraying was stopped at this time.

(3) In the smelting of the bottom-blowing nozzle converter, using the steelmaking control system to obtain real-time composition and temperature T of molten steel; the mass fraction of carbon in molten steel $\omega[C]$, the mass fraction of silicon $\omega[Si]$, the mass fraction of manganese $\omega[Mn]$, and the mass fraction of phosphorus $\omega[P]$. The steelmaking control system calculates the solidification temperature Tu (Formula 2) of molten steel according to the composition of the molten steel, and according to the temperature T of molten steel, calculates the real-time molten steel overheating degree $\Delta T$ (Formula 1).

$$\Delta T=T-Tu \quad \text{(Formula 1)}$$

$$Tu=1536.6-88\times\omega[C]-8\times\omega[Si]-5\times\omega[Mn]-30\times\omega[P] \quad \text{(Formula 2)}$$

Start spraying carbon dioxide while stopping the lime powder spraying. The oxygen was replaced by the same amount of carbon dioxide. The real-time molten steel overheating degree was 90° C. The blowing intensity of carbon dioxide, $I=\eta\times I_R=4/3\times0.3=0.4$ $Nm^3/t/min$. Correspondingly the blowing intensity of oxygen was reduced from 1.0 $Nm^3/t/min$ to 0.6 $Nm^3/t/min$; when the converter smelting time last for 11 min, the real-time molten steel overheating degree calculated by the bottom blowing control system over 100° C., the blowing intensity of carbon dioxide increases to $I=1.5\times\eta\times I_R=1.5\times4/3\times0.3=0.6$ $Nm^3/t/min$, Correspondingly the blowing intensity of oxygen was reduced to 0.4 $Nm^3/t/min$; when the converter smelting time last for 16.5 min, the composition and temperature of the molten steel reach the tapping standard, the bottom blowing of oxygen and carbon dioxide was stopped, and the converter was tapped. During this period, the real-time molten steel overheating degree under 150° C. (over 100° C.), the bottom blowing of carbon dioxide was maintained at 0.6 $Nm^3/t/min$.

After smelting, the actual flow pressure ratio of the narrow annuli channel $\varepsilon_A$ was reduced to 19. The implementation results show that the size of the mushroom head at the end of the bottom blowing nozzle increases after the blowing method of the present invention was used, which was close to the reference state, which avoids The nozzle was severely corroded due to the too small size of the mushroom head, which effectively protects the bottom blowing nozzle in time.

Control Example 1

Selecting the 120-ton bottom-spraying converter was as the same specifications with Example 1. The bottom-blowing nozzle specifications were the same, the reference flow pressure ratio $\varepsilon_R$ was 18. The actual flow pressure ratio $\varepsilon_A$ was 23; the molten steel was the same.

The existing method was adopted for smelting. The inner pipe channel of the bottom blowing nozzle was used to blowing oxygen and lime powder. The blowing intensity of lime powder was designed to be 6 kg/t/min, and the blowing intensity of oxygen was designed to be 1.0 $Nm^3/t/min$, no carbon dioxide was blown during the whole process; the narrow annuli channel blowing by the nozzle was used to spray nitrogen which as a cooling protection gas, and the blowing intensity of nitrogen was 0.2 $Nm^3/t/min$. In addition, in order to increase the oxygen intensity and speed up the smelting rhythm, the converter uses a four-hole supersonic oxygen lance for top-blowing oxygen, and the top-blowing intensity of oxygen was 2.5 $Nm^3/t/min$.

Before smelting of the bottom-blowing nozzle converter, the steelmaking control system calculates the total amount of lime powder this time according to structure and composition of the furnace charge $M_{CaO}$ was 30 kg/t steel. After smelting, the actual flow pressure ratio of the narrow annuli channel $\varepsilon_A$ was reduced to 29. The actual flow pressure ratio was further increased, and it was close to the flow pressure ratio in the unobstructed state. It explained that the size of the mushroom head was too small to protect the bottom blowing nozzle.

Control Example 2

Selecting the 120-ton bottom-spraying converter was as the same specifications with Example 1. The bottom-blowing nozzle specifications were the same, the reference flow pressure ratio $\varepsilon_R$ was 18. The actual flow pressure ratio $\varepsilon_A$ was 24; the molten steel was the same.

The inner pipe channel of the bottom blowing nozzle was used to blowing oxygen, carbon dioxide and lime powder. The blowing intensity of lime powder was designed to be 6 kg/t/min, and the blowing intensity of oxygen and carbon dioxide were designed to be 1.0 $Nm^3$/t/min, wherein the blowing intensity of oxygen was 0.4 $Nm^3$/t/min, the blowing intensity of carbon dioxide was 0.6 $Nm^3$/t/min. The mixture ratio of oxygen and carbon dioxide remains unchanged during the blowing process. The narrow annuli channel blowing by the nozzle was used to spray nitrogen which as a cooling protection gas, and the blowing intensity of nitrogen was 0.2 $Nm^3$/t/min. In addition, in order to increase the oxygen intensity and speed up the smelting rhythm, the converter uses a four-hole supersonic oxygen lance for top-blowing oxygen, and the top-blowing intensity of oxygen was 2.5 $Nm^3$/t/min.

Before smelting of the bottom-blowing nozzle converter, the steelmaking control system calculates the total amount of lime powder this time according to structure and composition of the furnace charge $M_{CaO}$ was 30 kg/t steel. After smelting, the actual flow pressure ratio of the narrow annuli channel $\varepsilon_A$ was reduced to 14. This means that the bottom-blowing nozzle was partially blocked; at the same time, carbon dioxide causes an increase in heat loss of the molten steel, and the molten steel temperature decreased by 32° C. when the steel was discharged.

Example 2

The present invention was applied to a 300-ton bottom-spraying converter. The bottom-blowing nozzle was a double-layer casing structure. The inner pipe channel of the bottom-blowing nozzle was used to blowing oxygen, carbon dioxide and lime powder. The total blowing intensity of oxygen and carbon dioxide designed to be 1.0 $Nm^3$/t/min, and the blowing intensity of lime powder was designed to be 5 kg/t/min; nitrogen as a cooling protection gas blowing by the narrow annuli channel, the blowing intensity of Gas was 0.1 $Nm^3$/t/min. In addition, in order to increase the oxygen intensity and speed up the smelting rhythm, the converter uses a six-hole supersonic oxygen lance for top-blowing oxygen, and the top-blowing intensity of oxygen was 2.4 $Nm^3$/t/min.

Testing the flow rate of narrow annuli channel was 30 $Nm^3$/t/min before installing the bottom-blowing nozzle, the pressure was 0.65 MPa, the flow-pressure ratio ($\varepsilon_u$) in the unobstructed state was 46, nitrogen as a cooling protection gas, the conversion factor was 0.7, the reference flow pressure ratio $\varepsilon_R$ was 32, the reference blowing intensity of carbon dioxide $I_R$ was 0.2 $Nm^3$/t/min.

The smelting step of any of the furnaces of the converter was taken as an example. The specific steps were as follows:

(1) Before smelting of the bottom-blowing nozzle converter, reading the gas flow rate was 30 $Nm^3$/t/min, and gas pressure was 1.2 MPa, the actual flow pressure ratio $\varepsilon_A$ was 25, the mushroom head state coefficient $\eta=\varepsilon_A/\varepsilon_R=25/32=0.78$, indicates that the size of the mushroom head was over big.

(2) Before smelting of the bottom-blowing nozzle converter, the steelmaking control system calculates the total amount of lime powder this time according to structure and composition of the furnace charge $M_{CaO}$ was 28 kg/t steel.

(3) In the smelting of the bottom-blowing nozzle converter, using the steelmaking control system to obtain real-time composition and temperature T of molten steel; the mass fraction of carbon in molten steel ω[C], the mass fraction of silicon ω[Si], the mass fraction of manganese ω[Mn], and the mass fraction of phosphorus ω[P]. The steelmaking control system calculates the solidification temperature Tu (Formula 1) of molten steel according to the composition of the molten steel, and according to the temperature T of molten steel, calculates the real-time molten steel overheating degree ΔT (Formula 2).

$$\Delta T=T-Tu \quad \text{(Formula 1)}$$

$$Tu=1536.6-88\times\omega[C]-8\times\omega[Si]-5\times\omega[Mn]-30\times\omega[P] \quad \text{(Formula 2)}$$

(4) After smelting of the bottom-blowing nozzle converter, oxygen was the carrier gas when spray blowing lime powder, the blowing intensity of oxygen was 1.0 $Nm^3$/t/min, the blowing intensity of lime powder was 5 kg/t/min, cooling the bottom blowing nozzle uses the physical endothermic effect of the temperature rise of the lime powder. After 5.6 minutes of continuous powder spraying, the amount of lime powder blowing reaches the total amount of lime powder calculated by the steelmaking control system, and the lime powder spraying was stopped at this time.

(5) Start spraying carbon dioxide while stopping the lime powder spraying. The oxygen was replaced by the same amount of carbon dioxide. The real-time molten steel overheating degree was 83° C. The blowing intensity of carbon dioxide, $I=\eta\times I_R=0.78\times0.2=0.156$ $Nm^3$/t/min. Correspondingly the blowing intensity of oxygen was reduced from 1.0 $Nm^3$/t/min to 0.844 $Nm^3$/t/min; when the converter smelting time last for 10.5 min, the real-time molten steel overheating degree calculated by the bottom blowing control system over 100° C., the blowing intensity of carbon dioxide increases to $I=1.5\times\eta\times I_R=1.5\times0.78\times0.2=0.234$ $Nm^3$/t/min, Correspondingly the blowing intensity of oxygen was reduced to 0.766 $Nm^3$/t/min; While the converter smelting time last for 16 min, the real-time temperature of the molten steel overheating over 150° C., the bottom blowing of carbon dioxide was increased at $I=2\times\eta\times I_R=2\times0.78\times0.2=0.312$ $Nm^3$/t/min, correspondingly the blowing intensity of oxygen was reduced to 0.688 $Nm^3$/t/min; While the converter smelting time last for 17.5 min, the composition and temperature of the molten steel reached the tapping standard and the stopped blowing oxygen and carbon dioxide, steel production from the converter.

After smelting, the actual flow pressure ratio of the narrow annuli channel $\varepsilon_A$ was raised to 31. The implementation results show that the size of the mushroom head at the end of the bottom blowing nozzle was reduced after adopting the blowing method of the present invention, which was close to the reference state. Avoid nozzle clogging due to oversized mushroom heads, and maintain the basic stability of mushroom head size.

Example 3

The present invention was applied to a 120-ton bottom-spraying converter. The bottom-blowing nozzle was a double-layer casing structure. The inner pipe channel of the bottom-blowing nozzle was used to blowing oxygen, carbon dioxide and lime powder. The total blowing intensity of oxygen and carbon dioxide designed to be 1.0 $Nm^3$/t/min, and the blowing intensity of lime powder was designed to be 6 kg/t/min; nitrogen as a cooling protection gas blowing by the narrow annuli channel, the blowing intensity of nitrogen was 0.2 $Nm^3$/t/min. In addition, in order to increase the oxygen intensity and speed up the smelting rhythm, the converter uses a four-hole supersonic oxygen lance for top-blowing oxygen, and the top-blowing intensity of oxygen was 2.5 $Nm^3$/t/min.

Testing the flow rate of narrow annuli channel was 24 $Nm^3/t/min$ before installing the bottom-blowing nozzle, the pressure was 0.8 MPa, the flow-pressure ratio ($\varepsilon_u$) in the unobstructed state was 30, nitrogen as a cooling protection gas, the conversion factor was 0.6, the reference flow pressure ratio $\varepsilon_R$ was 18, the reference blowing intensity of carbon dioxide $I_R$ was 0.3 $Nm^3/t/min$.

Taken the first furnace smelted after the converter was replaced with a new bottom blowing nozzle as an example. The specific steps were as follows:

(1) Because a newly replaced bottom blowing nozzle, there was no mushroom head covering the end of the bottom blowing nozzle before the first furnace was smelted. It was in the unobstructed state, so the actual flow pressure ratio $\varepsilon_A$ was 30, the mushroom head state coefficient $\eta=\varepsilon_A/\varepsilon_R=30/18/5/3$.

(2) Before smelting of the bottom-blowing nozzle converter, the steelmaking control system calculates the total amount of lime powder this time according to structure and composition of the furnace charge $M_{CaO}$ was 30 kg/t steel.

After smelting of the bottom-blowing nozzle converter, oxygen was the carrier gas when spray blowing lime powder, the blowing intensity of oxygen was 1.0 $Nm^3/t/min$, the blowing intensity of lime powder was 6 kg/t/min, cooling the bottom blowing nozzle uses the physical endothermic effect of the temperature rise of the lime powder. After 5 minutes of continuous powder spraying, the amount of lime powder blowing reaches the total amount of lime powder calculated by the steelmaking control system, and the lime powder spraying was stopped at this time.

(3) In the smelting of the bottom-blowing nozzle converter, using the steelmaking control system to obtain real-time composition and temperature T of molten steel; the mass fraction of carbon in molten steel ω[C], the mass fraction of silicon ω[Si], the mass fraction of manganese ω[Mn], and the mass fraction of phosphorus ω[P]. The steelmaking control system calculates the solidification temperature Tu (Formula 1) of molten steel according to the composition of the molten steel, and according to the temperature T of molten steel, calculates the real-time molten steel overheating degree ΔT (Formula 2).

$$\Delta T=T-Tu \quad \text{(Formula 1)}$$

$$Tu=1536.6-88\times\omega[C]-8\times\omega[Si]-5\times\omega[Mn]-30\times\omega[P] \quad \text{(Formula 2)}$$

Start spraying carbon dioxide while stopping the lime powder spraying. The oxygen was replaced by the same amount of carbon dioxide. The real-time molten steel overheating degree was 90° C. The blowing intensity of carbon dioxide, $I=1.5\times\eta\times I_R=5/3\ 0.3=0.5\ Nm^3/t/min$. Correspondingly the blowing intensity of oxygen was reduced from 1.0 $Nm^3/t/min$ to 0.5 $Nm^3/t/min$; when the converter smelting time last for 11 min, the real-time molten steel overheating degree calculated by the bottom blowing control system over 100° C., the blowing intensity of carbon dioxide increases to $I=1.5\times\eta\times I_R=1.5\times5/3\times0.3=0.75\ Nm^3/t/min$, correspondingly the blowing intensity of oxygen was reduced to 0.25 $Nm^3/t/min$; when the converter smelting time last for 16.5 min, the composition and temperature of the molten steel reach the tapping standard, the bottom blowing of oxygen and carbon dioxide was stopped, and the converter was tapped. During this period, the real-time molten steel overheating degree under 150° C., the bottom blowing of carbon dioxide was maintained at 0.75 $Nm^3/t/min$.

After smelting, the actual flow pressure ratio of the narrow annuli channel $\varepsilon_A$ was reduced to 22. It shows that the end of the bottom-blowing nozzle had been covered by the mushroom head, which can form protection for the bottom blowing nozzle and inhibit its erosion; in addition, the actual flow pressure ratio at the end of the first furnace smelting was still slightly larger than the benchmark flow pressure ratio, and the blowing control method of the present invention can be continued in the subsequent furnace times to effectively regulate the mushroom head size to the benchmark state and basically keep it stable.

The implementation results show that the size of the mushroom head at the end of the bottom blowing nozzle increases after the blowing method of the present invention was used, which was close to the reference state, which avoids that the nozzle was severely corroded due to the too small size of the mushroom head, which effectively protects the bottom blowing nozzle in time.

After adopting the blowing method of the present invention, the life of this bottom-blowing powder converter reached more than 2000 furnaces (still available at 2000 furnaces), which were more than 500 furnaces higher than the traditional blowing method (the same new bottom-blowing nozzle converter).

The specific examples described above provide a quantitative and detailed description of the purpose, technical solutions and beneficial effects of the present invention. It should be understood that the above-mentioned were only specific examples of the present invention and were not intended to limit the present invention.

In the present invention, nearby the bottom blowing nozzle, the heat source was the reaction exothermic heat between the inner tube $O_2$ and molten steel, the convective heat transfer of high temperature molten steel, and the cold source was the heat absorption of the reaction between the inner tube $CO_2$ and molten steel, and the temperature of the inner tube lime powder The physical endothermic, the reaction endothermic of the cracking of natural gas in the annular joint, and the physical endothermic of the heating of the annular joint nitrogen, promote the condensation of molten steel into metal mushroom heads by limiting the injection parameters of the cold source and the heat source; a large number of research and production practices had shown that in the converter during the blowing process, the degree of superheat of the molten steel changes. The present invention dynamically adjusted the cooling intensity of the bottom blowing nozzle according to the change of the degree of superheat of the molten steel, which can effectively stabilize the mushroom head size and reduced the amount of carbon dioxide used, which solved the prior art due to the endothermic characteristics of $CO_2$ reaction, $CO_2$ blowing would reduce the problem of excess heat in the converter.

The invention claimed is:

1. A blowing control method for maintaining a mushroom head of a bottom-blowing converter, comprising the following steps:

(1) blowing nitrogen as a cooling protection gas by a narrow annuli channel of a bottom-blowing nozzle, and measuring a flow rate and a gas pressure of nitrogen in the narrow annuli channel-blowing by a nozzle, and calculating a state coefficient of the mushroom head;

(2) starting a smelting process in the bottom-blowing converter, with oxygen as a carrier gas blow blown with a lime powder by an inner pipe channel of the bottom-blowing nozzle; then after blowing the lime powder with the oxygen, blowing a carbon dioxide-oxygen mixed gas by the inner pipe channel of the bottom-blowing nozzle to maintain the mushroom head of the bottom-blowing converter; according to the calculated state coefficient of the mushroom head and a molten steel overheating degree ΔT adjusting a blowing intensity of carbon dioxide in the carbon dioxide-oxygen mixed gas; the molten steel overheating degree ΔT being calculated according to Formula 1:

$$\Delta T = T - Tu \quad \text{(Formula 1)}$$

wherein, T is a temperature of the molten steel measured or calculated during the smelting process; Tu is calculated according to formula 2:

$$Tu = 1536.6 - 88 \times \omega[C] - 8 \times \omega[Si] - 5 \times \omega[Mn] - 30 \times \omega[P] \quad \text{(Formula 2)}$$

wherein, ω[C] is a mass fraction of carbon in the molten steel, ω [Si] is a mass fraction of silicon in the molten steel, ω[Mn] is a mass fraction of manganese in the molten steel, and ω [P] is a mass fraction of phosphorus in the molten steel wherein, in step (1), the flow rate is Q, the gas pressure is P, a ratio of Q and P is defined as actual flow pressure ratio ε.sub.A, a ratio of the actual flow pressure ratio ε.sub.A to a reference flow pressure ratio ε.sub.R is defined as the state coefficient of the mushroom head n, wherein the reference flow pressure ratio $$\varepsilon.sub.R = \alpha \times \varepsilon.sub.u,$$

ε.sub.u is a flow pressure ratio of the end of the narrow annuli channel blowing by the nozzle freely; a ranges 0.6 to 0.7.

2. The method according to claim 1, wherein in step (2), the oxygen used as the carrier gas blown with the lime powder, has a blowing intensity ranging from 0.8 to 1.2 (Nm.sup.3/t/min), a blowing intensity of the lime powder ranges from 4 to 6 (kg/t/min).

3. The method according to claim 1, wherein, in step (2), adjusting the blowing intensity of carbon dioxide comprises:

if the molten steel is overheated at $\Delta T \leq 100°$ C., the blowing intensity of carbon dioxide is $I = \eta \times I_R$;

if the molten steel is overheated at $100° C. \leq \Delta T \leq 150°$ C., the blowing intensity of carbon dioxide is $I = 1.5 \times \eta \times I_R$;

if the molten steel is overheated at $\Delta T > 150°$ C., the blowing intensity of carbon dioxide is $I = 2 \times \eta \times I_R$;

$I_R$ is a reference blowing intensity of carbon dioxide.

4. The method according to claim 3, wherein the reference blowing intensity of carbon dioxide ranges from 0.2 to 0.3 Nm.sup.3/t/min.

* * * * *